US009171680B2

(12) United States Patent
Grogg et al.

(10) Patent No.: US 9,171,680 B2
(45) Date of Patent: Oct. 27, 2015

(54) NANOELECTROMECHANICAL SWITCH WITH LOCALIZED NANOSCALE CONDUCTIVE PATHWAY

(71) Applicant: International Business Machines Corporation, Armonk, NY (US)

(72) Inventors: Daniel Grogg, Zurich (CH); Laurent A. Dellmann, Birmensdorf (CH); Michel Despont, Cheseaux-Noréaz (CH); Abu Sebastian, Adliswil (CH)

(73) Assignee: International Business Machines Corporation, Armonk, NY (US)

( * ) Notice: Subject to any disclaimer, the term of this patent is extended or adjusted under 35 U.S.C. 154(b) by 207 days.

(21) Appl. No.: 14/039,935

(22) Filed: Sep. 27, 2013

(65) Prior Publication Data

US 2014/0090964 A1 Apr. 3, 2014

(30) Foreign Application Priority Data

Sep. 28, 2012 (GB) ..... 1217389.4

(51) Int. Cl.
*H01H 1/00* (2006.01)

(52) U.S. Cl.
CPC ..... *H01H 1/0094* (2013.01); *H01H 2001/0052* (2013.01)

(58) Field of Classification Search
CPC ..... H01H 1/00; H01H 59/00; H01H 51/22; H01L 21/00
USPC ..... 200/181, 16 B, 16 D, 512, 61.48, 200/262–270, 275
See application file for complete search history.

(56) References Cited

U.S. PATENT DOCUMENTS

| | | | |
|---|---|---|---|
| 5,638,946 | A | 6/1997 | Zavracky |
| 2004/0075514 | A1 | 4/2004 | Ono et al. |
| 2009/0256594 | A1 | 10/2009 | Zhu |
| 2010/0038730 | A1 | 2/2010 | Sandhu et al. |
| 2010/0140066 | A1 | 6/2010 | Feng et al. |

OTHER PUBLICATIONS

A. Sebastian et al., "Resistance switching at the nanometer scale in amorphous carbon," New J. Phys., 13 013020 (Jan. 2011).
Owen Y. Loh et al., "Nanoelectromechanical contact switches," Nature Nanotechnology, vol. 7 (May 2012).

*Primary Examiner* — Edwin A. Leon
*Assistant Examiner* — Iman Malakooti
(74) *Attorney, Agent, or Firm* — Gail H. Zarick; Michael J. Chang, LLC

(57) ABSTRACT

The present invention is directed to a nanoelectromechanical (NEM) switch comprising two electrodes (12, 18), wherein: at least one (18) of the electrodes comprises an active layer (10) thereon; and at least one (12) of the electrodes is movable along a given direction (z), from a: non-contact position to a contact position where one of the electrodes contacts the other one (18) of the electrodes, at the level of a contact point (P); and the active layer exhibits a conductive pathway (16), which pathway: extends along said given direction (z) to enable electrical conduction from one of the electrodes to the other one of the electrodes in the contact position; and is confined to a given region (R1) of the active layer, the region having nanoscale dimensions in a sectional plane (x, y) perpendicular to the given direction. The present invention is further directed to related devices, systems and methods.

18 Claims, 4 Drawing Sheets

NANOELECTROMECHANICAL SWITCH WITH LOCALIZED NANOSCALE CONDUCTIVE PATHWAY

FIELD OF THE INVENTION

The invention relates in general to nanoelectromechanical switches and in particular to solutions for obtaining good electrical contact quality for such switches.

BACKGROUND OF THE INVENTION

As power and energy constraints in microelectronic applications become more and more challenging, one is seeking alternative and more power efficient ways of switching, for subsequent use in computing. A conventional switching device used in the semiconductor industry is a C-MOS transistor. To overcome power-related bottlenecks in C-MOS devices, various switching devices which operate on fundamentally different transport mechanisms such as tunneling were investigated. However, combining the desirable characteristics of high on-current, very low off-current, abrupt switching, high speed as well as a small footprint in a device that might be easily interfaced to a C-MOS device is a challenging task. Mechanical switches such as nano-electromechanical switches (NEM switches) are promising devices to meet these kinds of criteria. A nano-electromechanical switch having a narrow gap between electrodes can be controlled by electrostatic actuation. In response to an electrostatic force a contact electrode can be moved or bent to contact another electrode thus closing the switch. The control of the narrow gap for the electrostatic actuation and for the electrical contact separation is a main issue in designing and operating nano-electromechanical switches. A nano-electromechanical switch typically has to meet both the requirement of high switching speed and low actuation voltage.

Common electromechanical switches use straight cantilever beams as switching elements. As the applicant has demonstrated, such solutions can be improved by using a NEM switch including: an actuator electrode and a curved cantilever beam flexing in response to an activation voltage (applied between the actuator electrode and the curved cantilever beam) for ensuring electrical contact between the curved cantilever beam and an output electrode of the switch. Such a switch can further be designed such that before, during and after flexing the curved cantilever beam, a gap remains between the curved cantilever beam and the actuator electrode, which is substantially uniform across the two facing electrodes and optimized for a minimum field in the closed state to minimize the switching energy of the device. The flexing may for instance occur mainly in a hinge portion of said cantilever beam connecting the curved cantilever beam with an input electrode of the NEM switch and the motion of the curved cantilever beam can be approximated as a rotation around the flexible hinge.

Today, NEM switches are notably contemplated for use as relays, transistors, logic devices and sensors. They are very attractive due to very low leakage currents as well as very high ON/OFF ratio. NEM switch technology is expected to complement the established CMOS technology, at least in several niche application areas.

A key challenge for NEM switches is the electrical contact quality; reliability is a related concern. Other potential issues to consider are: stiction/adhesion; wear and tear due to mechanical actuation, resulting in changes in the effective electrical contact area with time; and damages caused by electrical discharge (ablation or localized melting due to parasitic capacitive discharge while closing the switch), a thing that may become of particular when the contact resistance is very small. High contact resistance on the other hand leads to high power consumption, increased delay and decreased signal-to-noise ratios (SNRs).

BRIEF SUMMARY OF THE INVENTION

According to a first aspect, the present invention is embodied as a nano-electromechanical switch (or NEM switch), having two electrodes, wherein:

- at least one of the electrodes includes an active layer thereon; and at least one of the electrodes is movable along a given direction, from a:
  - non-contact position to
  - a contact position where one of the electrodes contacts the other one of the electrodes, at the level of a contact point; and the active layer exhibits a conductive pathway, which pathway:
  - extends along said given direction to enable electrical conduction from one of the electrodes to the other one of the electrodes in the contact position; and
  - is confined to a given region of the active layer, said region having nanoscale dimensions in a sectional plane perpendicular to said given direction.

In embodiments, the NEM switch may include one or more of the following:

- the active layer is at least on a first one of the electrodes and includes a protrusion in said given region, the protrusion supporting at least a part of the conductive pathway and protruding toward a second one of the electrodes, along said given direction;
- the active layer is a resistive layer and said given region is a first region of the active layer, surrounded by and contiguous with a second region of the active layer, wherein said resistive layer exhibits: said conductive pathway, the latter extending through a thickness of the resistive layer along said direction; and no conductive pathway in the second region;
- an average diameter of said conductive pathway in a sectional plane perpendicular to said given direction, at the level of said contact point, is of the same order of magnitude as, or preferably less than, the smallest of the average diameters of said electrodes at the level of said contact point;
- the first region exhibits one or more material structural properties that are characteristic of a conditioning process including application of one or more voltage pulses or current pulses;
- an electrical resistance of the first region is at least 10 times smaller than an electrical resistance of the second region;
- the active layer includes several contiguous layers;
- the resistive layer has a non-linear current-voltage characteristic;
- the conductive pathway has an average diameter of less than 50 nanometers, preferably less than 10 nanometers, more preferably less than 2 nanometers, in a sectional plane perpendicular to said given direction; and the active layer has a thickness of less than 100 nanometers, preferably less than 40 nanometers, and more preferably less than 20 nanometers;
- the active layer is a resistive layer that mainly includes one of the following materials: amorphous carbon, at least partly crystallized diamond-like carbon, tetrahedral amorphous carbon, hydrogenated amorphous carbon, or doped carbon;

the active layer is a resistive layer that mainly includes: a phase-change material, for example GeSbTe or GeTe, or oxides such as HfOx, WOx, SiOx, TaOx, or TiOx; and the active layer includes a combination of: a metal layer including a metal such as Cu, Au or Ag; and a resistive solid electrolyte such as SiOx, GeS, GeSe, $WO_3$, $TiO_2$ or $ZrO_2$.

According to another aspect, the invention is embodied as a method of operating any of the above-described NEM switches, the method including:

at least one step of setting the electrodes in said contact position to let mobile electric charges pass from one of the electrodes to the other one of the electrodes, the method further comprising, prior to said at least one step of setting the electrodes in said contact position:

forming in the active layer or conditioning the active layer for it to exhibit said conductive pathway.

Preferably, said active layer is a resistive layer deposited at least on a first one of the electrodes and the method includes a prior step of conditioning the resistive layer for it to exhibit said nanoscale conductive pathway; conditioning includes applying one or more voltage pulses or current pulses; and, preferably, applying said one or more voltage pulses or current pulses is carried via a second one of the electrodes.

The method may furthermore include an additional conditioning step to at least partly reverse a previous conditioning step.

Devices, apparatuses and methods embodying the present invention will now be described in more detail, by way of non-limiting examples, and in reference to the accompanying drawings.

DETAILED DESCRIPTION OF THE INVENTION

In reference to FIGS. 1 to 11, an aspect of the invention is first described, which generally concerns a NEM switch.

Figure 1:
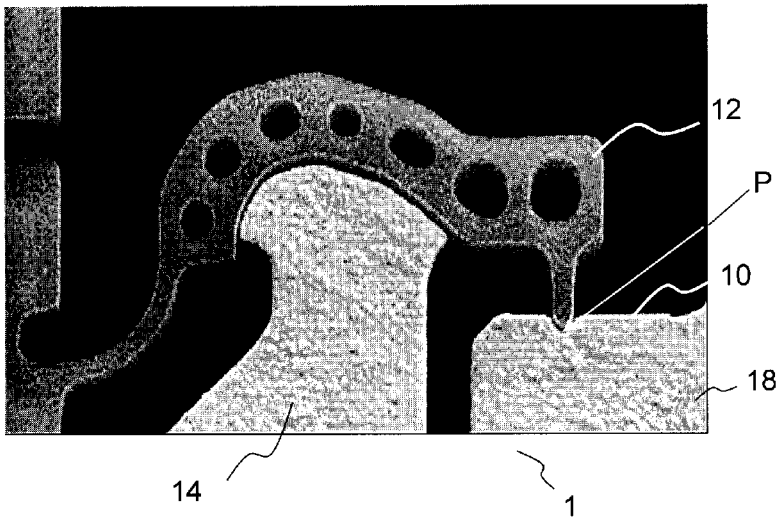
FIG. 1 is a scanning electron microscopy image of an example of a NEM switch suited for embodying aspects of the invention.

FIG. 1 is a scanning electron microscopy image; it shows an example of a NEM switch design suited for embodying the present invention. In this example, the switch 1 includes: an actuator electrode 14 and a curved cantilever beam 12 flexing in response to an activation voltage (applied between the actuator electrode 14 and the curved cantilever beam 12). Flexion of the curved cantilever beam 12 leads to electrical contact between the curved cantilever beam 12 and the output electrode 18 of the switch L Yet, as it will be apparent to the reader, the contribution of the present invention concerns the electrical contact quality and reliability; it can therefore be applied to other types of NEM switches, e.g., switches that use straight cantilever beams as switching elements. In all cases, we assume that at least one electrode 12 is movable, e.g., along a given direction z, to contact the other one 18 of the electrodes. Also, both electrodes could be moved at the same time to achieve the same. Thus, at least one electrode is able to move from a non-contact position to a contact position, where both electrodes come in contact at a given contact point P, i.e., to ensure the operation of switching. Note that although in the example of FIG. 1 the curved cantilever beam 12 flexes about a hinge, i.e., a "rotation point", the beam 12 and in particular the end portion thereof is movable along direction z, such as to be able to contact the counterpart electrode 18. The direction z can be taken as the vertical line passing through said contact point P.

Figure 2:
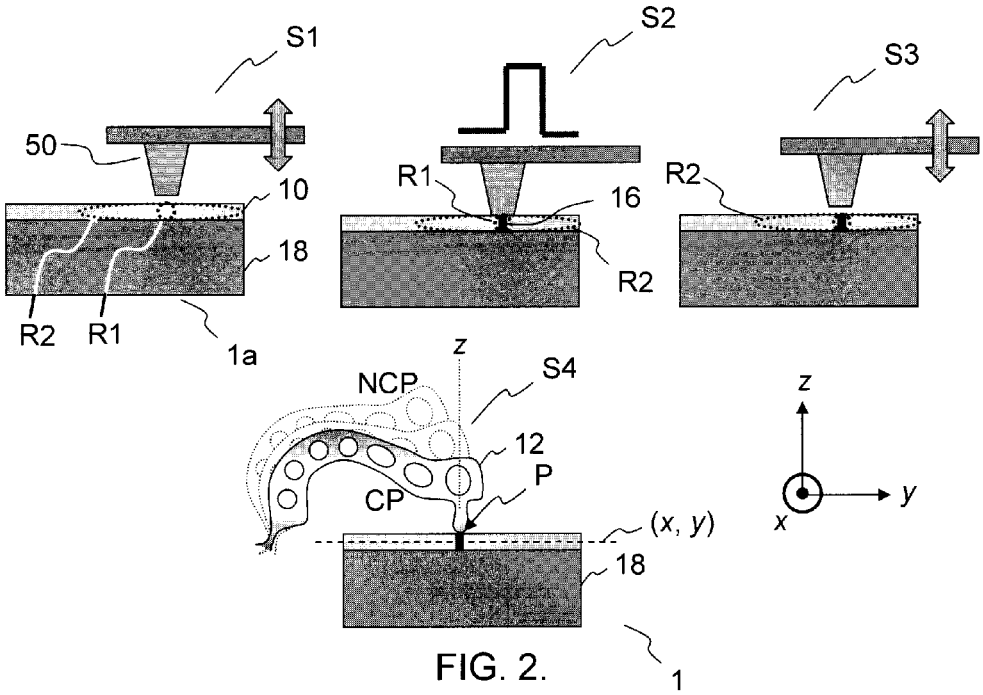
FIG. 2 schematically illustrates components of a NEM switch device, as well as steps of a method for conditioning and operating the switch, according to embodiments.
Figure 3:
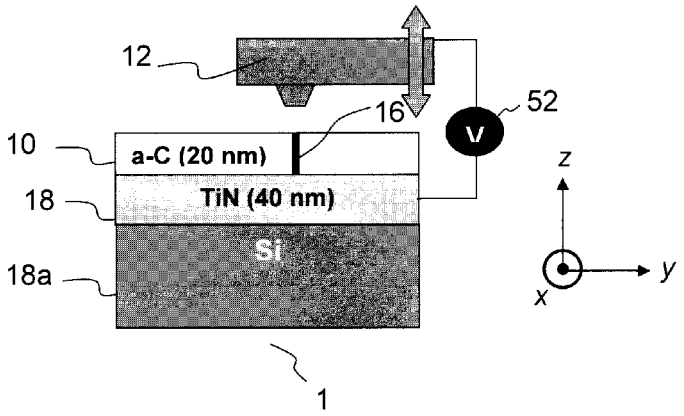
FIG. 3 schematically illustrates components of a NEM switch device, according to specific embodiments.

Next, at least one electrode 18, or possibly each of the two electrodes 12, 18 shall include an "active" layer, deposited thereon, e.g., on the upper surface 10 of electrode 18. This layer is typically a thin film that would hardly be visible on the scale of FIG. 1. The active layer is called "active" in the sense that it involves action, is capable of reacting to a suitable process to produce the desired result. In the present context this layer can be shaped, formed, conditioned or functionalized, etc., to exhibit a nanoscale conductive pathway 16, as illustrated in FIGS. 2, 3, 8, 10, 11. The latter extends along direction z to enable electrical conduction from one electrode 12 to the other 18. This conductive pathway 16 is otherwise confined to a given region R1 of the active layer 10, which region R1 has nanoscale dimensions in a sectional plane (x, y) perpendicular to direction z, as depicted in FIG. 2 or 3.

The conductive pathway 16 is essentially confined to a region R1, i.e., there is no such conductive pathway in the peripheral region that surrounds region R1. In other words, the conductive pathway is essentially confined along z and does not substantially extend in any sectional plane (x, y), or at least not significantly with respect to the electrodes' sizes. That is, even if the length of extension of the conductive pathway along z can be small, the average dimension of the conductive pathway in a plane (x, y) shall be substantially smaller than the average dimension of the mean plane of the active layer 10 in a plane (x, y).

Advantage is thus made of an active material layer that can be suitably formed or conditioned, to exhibit a localized conductive pathway. By adequately tuning the forming/conditioning process with respect to the material used for the active layer 10, a large resistance gradient can be achieved. The conductive area furthermore has a nanoscale average dimension in a sectional plane (x, y), e.g., a dimension less than a few tens of nanometers, which altogether with the large resistance gradient allows for very good resistance contrasts to be obtained. The nanoscale pathway is typically smaller than the smallest electrode, i.e., electrode 12 in FIG. 1, in a sectional plane (x, y) at the level of the contact point P. For completeness, designs such as described above are much less sensitive to issues such as the lack of well-defined contact area, multiple asperities, or variability across devices, which issues are customary with prior NEM switches.

NEM switches as described herein can otherwise be operated as usual, i.e., electrodes are set in contact to let mobile electric charges pass from one electrode to the other. Such operations are typically carried out a large number of times. Still, applications can be contemplated for "one-time" switches. In all cases, it is taken advantage of a small, well defined and controlled (and if necessary tunable) contact area.

Also, prior to contacting electrodes, the active layer 10 is processed S1-S3 or conditioned for it to exhibit the nanoscale conductive pathway 16, as schematically depicted in FIG. 2. This process allows one to turn-on the NEM switch prior to the regular operation of the device; it is limited to the region of interest, i.e., region R1, such that no additional specific forming/conditioning process is needed, e.g., in a surrounding region R2.

Preferably, the average diameter of the conductive pathway in a sectional plane (x, y) at the level of the contact point P is on the same order of magnitude, or more preferably slightly less (if at all possible) than the smallest of the average diameters of said electrodes, in the same plane. The size ratio sr at the level of the contact point P is thus ideally on the order of 1/1 (but typically one has 1/10<sr 21 10/1 in practice) (note that the drawings in FIGS. 2, 3, 8, 10, 11 are not at scale, for clarity reasons). Such size ratios allow for good contrasts to be obtained in practice.

To illustrate this more quantitatively, a conductive pathway 16, 16*p* shall preferably be designed such as to exhibit an average diameter of less than 50 nanometers in a sectional plane (x, y) at the level of the contact point P. Still, for scaling reasons, one may want to reduce its size to less than 10 nanometers, or even less than 2 nanometers in some specific applications. Correspondingly, the active layer 10 shall preferably have a thickness of less than 100 nanometers (more preferably less than 40 nanometers, or even less than 20 nanometers).

Two main embodiments can be distinguished at this point. The first one is schematically captured in FIGS. 8, 9 and 11, while the second one is reflected in FIGS. 2, 3 and 10.

Figure 8:
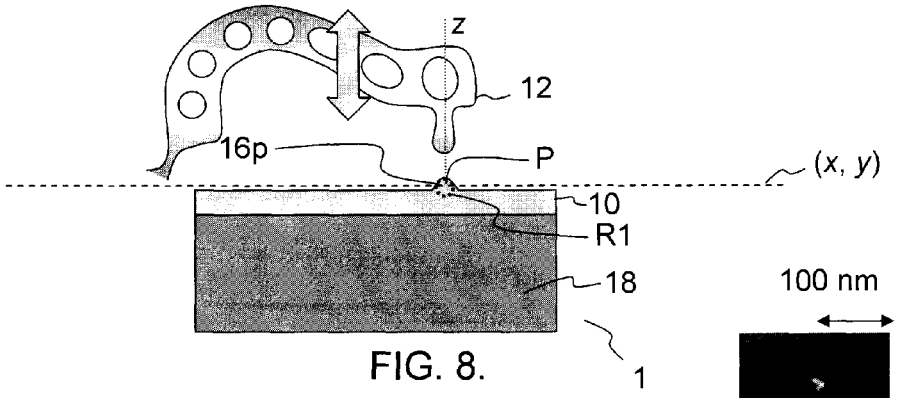
FIG. 8 schematically illustrates components of a NEM switch, where the nanoscale conductive pathway is supported by a topographic protrusion, according to other embodiments.
Figure 9:
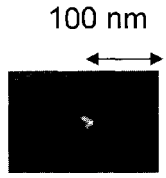
FIG. 9 is a Scanning Tunneling Microscope image of such a topographic protrusion, as involved in embodiments.
Figure 11:
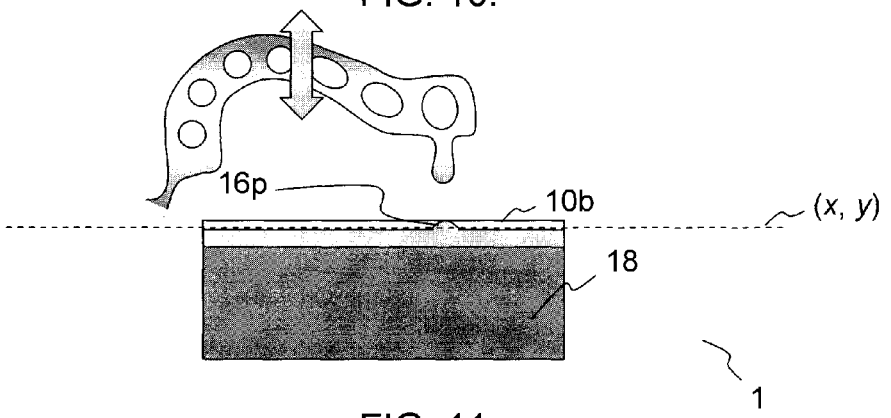
FIG. 11 schematically depicts a variant combining aspects of FIGS. 8 and 10.

The first type of embodiments is discussed first, in reference to FIGS. 8, 9 and 11. FIG. 8 schematically illustrates a NEM switch, where the nanoscale conductive pathway is supported by a topographic protrusion 16*p*. FIG. 9 shows a Scanning Tunneling Microscope (or STM) image of such a topographic protrusion 16*p*. The active layer 10 is deposited at least on a first one 18 of the electrodes and comprises the protrusion 16*p* at the level of a region R1. The protrusion 16*p* protrudes toward the second one of the electrodes along said given direction z; it supports (at least partly) the conductive pathway from one electrode to the other. Thus, in such embodiments, a nanoscale topographical projection is formed prior to the normal use of the NEM switch, e.g., by application of voltage/current pulses to the active layer. The topographical projection will serve as a well-defined contact.

As present inventors have realized, topographical protrusions suited for the present purpose can for instance be obtained by electron emission induced modifications, e.g., in amorphous tetrahedral diamondlike carbon surface, a technique that was demonstrated in another context in the late 90's see e.g., Applied Physics Letters, vol 7218, pp. 2244, 1998. A typical protrusion that results from such a process is shown in FIG. 9. The protrusion shown in this example was obtained by electrically conditioning an amorphous (a-tC) carbon film.

To conclude on this first type of embodiments: providing a protrusion 16*p* adequately dimensioned and protruding along the electrodes' movement direction z is one way of ensuring a well defined electrical contact, to enable electrical conduction from one electrode to the other. The conductive pathway is confined to the protrusion 16*p* and does not extend beyond the corresponding region R1, either because there is no supporting material beyond R1 in a sectional plane (x, y) as depicted in FIG. 8, or because a surrounding material is not conductive.

Note, in that respect, that the active layer may in fact include several contiguous layers 10, 10*b*, as illustrated in FIG. 11, to make it possible to decouple mechanical and chemical properties from electrical properties. Yet, the material 10*b* surrounding the protrusion 16*p* such as to be level therewith at the level of the contact point P needs not be conductive and preferably is not. The effective conductivity of this material shall depend on its thickness, which may be very small, depending on the role to be played by the additional layer 10*b*. This will be discussed later in more detail, in reference to the other type of embodiments.

The second type of embodiments is now described in detail, in reference to FIGS. 2-7, and 10. In such embodiments, the active layer is a resistive layer 10; said region R1 is a first region of the active layer, surrounded by and contiguous with a second region R2 of the active layer 10. The nanoscale conductive pathway 16 extends in that case through the whole thickness of the resistive layer 10. The surrounding region R2 exhibits no such conductive pathway. Here advantage is taken from a resistive material that can switch its electrical resistance in a localized manner, thanks to a suitable conditioning process.

Figure 10:
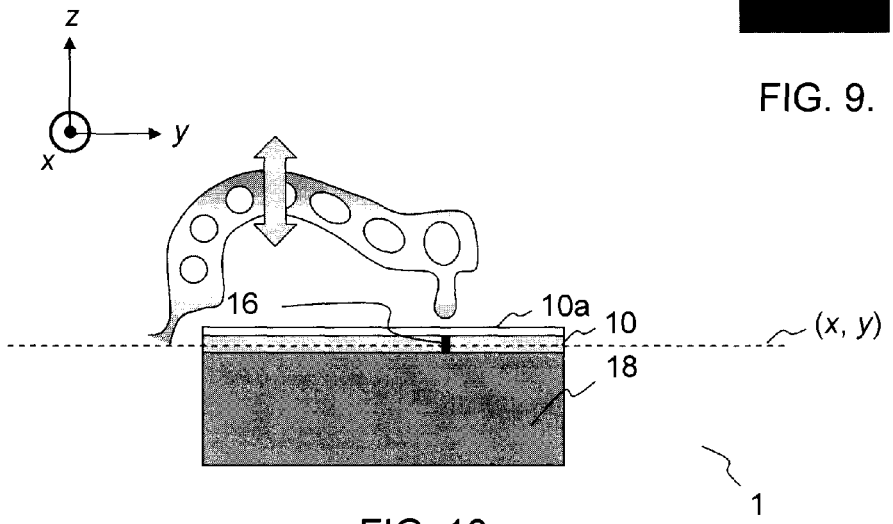
FIG. 10 schematically depicts a variant to FIG. 2, wherein the resistive layer is complemented by a passive layer, as involved in embodiments.

FIG. 10 schematically depicts a variant to FIG. 2, wherein an additional passive layer 10*a* is used. More generally, the active layer may include several contiguous layers. A NEM contact switch with a tunable contact resistance element consisting of a single or multiple active material layers in combination with additional passive layers allows for decoupling electrical, mechanical and chemical properties of the NEM switch. For example, one or more additional passive (yet conducting) layers 10*a* might be used to ensure a planar surface is exposed to the contacting electrode, as illustrated in FIG. 10. More in detail, such a passive capping layer 10*a* may be conductive in the z direction. However, in the lateral direction, it is very resistive because of its small thickness (typically less than 10 or 20 nanometers). In variants, additional passive and non-conducting layers might be used. The same considerations also apply to embodiments where a protruding pathway is used, as in FIG. 11.

As present inventors have realized too, it can again be made use of voltage/current pulses, this time to locally switch the material's electrical resistance, see step S2 in FIG. 2. Advantageously, voltage/current pulses can be applied directly via the opposite electrode 12, such that no specific additional equipment is required to turn the device "on". Conversely, should the opposite electrode's dimensions or material be inadequate for this purpose, a dedicated electrode 50 (e.g., a cantilever probe tip) may be used, as illustrated in FIG. 2, to locally switch the resistance of layer 10.

When adequately tuning the conditioning process vs. the material used for the resistive layer, the resistive layer can switch from very high resistance to very low resistance. The switching area (perpendicular to z) still has nanoscale dimensions, which allows for good resistance contrasts to be obtained. Again, no appreciable topography change is observed during the switching process, as discussed later in reference to FIG. 4. And in this case too the conditioning process is limited to the region of interest: there is no need to condition the surrounding region R2.

A thing that inventors observed in practice is that the electrical resistance of the first region R1 should preferably be at least 10 times smaller than the resistance in the surrounding region R2, to achieve reasonably strong switching performance. In fact, embodiments of the invention allow for electrical (e.g., ohmic) resistances to easily differ by two orders of magnitude, or more, as seen e.g., in FIG. 7.

To that aim, the resistive layer 10 may mainly include amorphous carbon, like in the embodiment of FIG. 3. More generally, layer 10 may also include: at least partly crystallized diamond-like carbon, tetrahedral amorphous carbon or hydrogenated amorphous carbon. In each of these cases, advantage can be taken of the possibility to use a Joule-heating induced localized clustering of sp2 carbon atoms to form graphitic chains, which mechanism leads to the desired property, as known per se in the context of applied physics. Still, the resistive layer 10 may mainly include doped carbon, e.g., doped with additional elements like metals, nitrogen or oxygen.

In particular, a highly localized resistance switching was enabled in thin films of amorphous carbon (a-C, FIG. 3), using a suited electrode 12. More precisely, a Silicon/TiN/Carbon material stack was used, i.e., (i) a 25 nm a-C active layer 10 on top of (ii) a 40 nanometer (nm) TiN layer, serving as one 18 of the electrodes, itself on top of (iii) a Si substrate. A Ptlr electrode 12 was used to apply voltage pulses and locally switch the material. The a-C resistance switching can be induced with application of sufficient bias voltage. A reliable nanoscale electrical contact is formed, which allows at least ~10000 NEM switching cycles. For purposes described below, the deflection signal can be monitored, using typical AFM techniques. Voltage signals can be applied using a DAC+Amplifier and the current measured using a logarithmic amplifier+ADC.

The electrical contact was tested prior to switching. The Ptlr electrode was brought in contact to the Material stack; a bias voltage of 2V was applied, there was hardly any current flowing through the electrode, the contact quality was poor and heavily dependent on the loading force (about 0.2 microamperes on average). Repeating the same experiment after switching, however, gave rise to a considerably improved contact quality, with currents of more than 100 microamperes flowing through the electrode.

Figure 4:
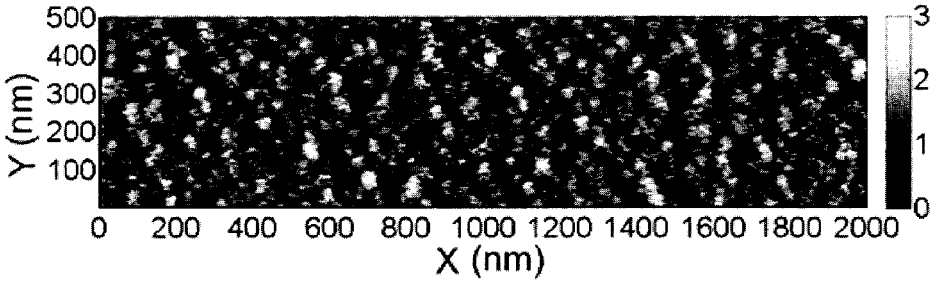
FIG. 4 is a topographic map of a layer of amorphous carbon locally switched to exhibit a conductive pathway, as obtained with the set-up of FIG. 3.
Figure 5:
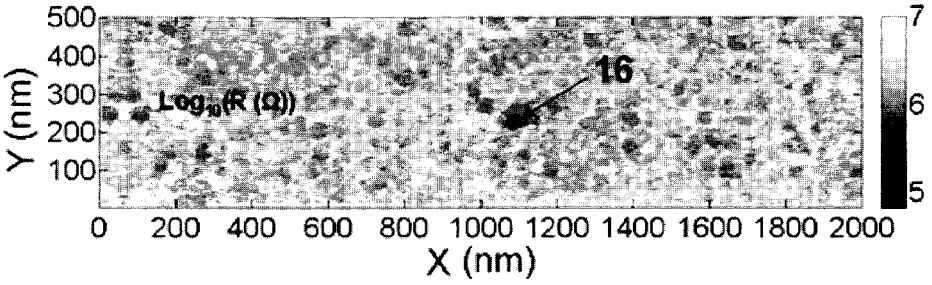
FIG. 5 is a resistance map ($Log_{10}$ (R) corresponding to the topographic map of FIG. 4.

No perceivable change in topography resulted from the conditioning process, after switching, as illustrated in the topography map of FIG. 4 (obtained using conductive Atomic Force Microscopy or AFM). However, a marked change in resistance results (of one to two orders of magnitude), as seen in FIG. 5. FIG. 5 is a resistance map corresponding to the topographic map of FIG. 4, where the function $Log_{10}(R)$ of the resistive layer is rendered using again conductive AFM. A dark spot is observed at the level of the switched area 16, indicating a resistance drop.

Very interestingly, the voltage at which resistance switching is initiated is a function of the thickness of the carbon film. As present inventors observed, there is an almost linear dependence, i.e., by passing more current, the switched resistance value can be tuned in a continuous manner. More generally, in some resistive materials, such as amorphous carbon, it is possible to tune the resistance of the switched region by controlling the current during the switching process. This helps to address the trade-off between high and low contact resistances, i.e.:

A high contact resistance implies increased power dissipation, delays and low SNR; while Low contact resistance results in increased ablation or localized melting due to parasitic capacitive discharge.

The ability to tune the contact resistance can also be used to create more uniform contact resistance among various devices on a chip.

In practice, the application of the voltage/current pulses is carried directly via the opposite electrode 12, as touched earlier. Typically, one pulse of duration at least 100 nanoseconds and a voltage chosen in the range of 1 to 10 V suffice to obtain the switching property. A current-mode conditioning process can equally be used, with pulse duration of at least 100 nanoseconds and current range of 10 microamperes to 10 milliamperes.

Figure 6:
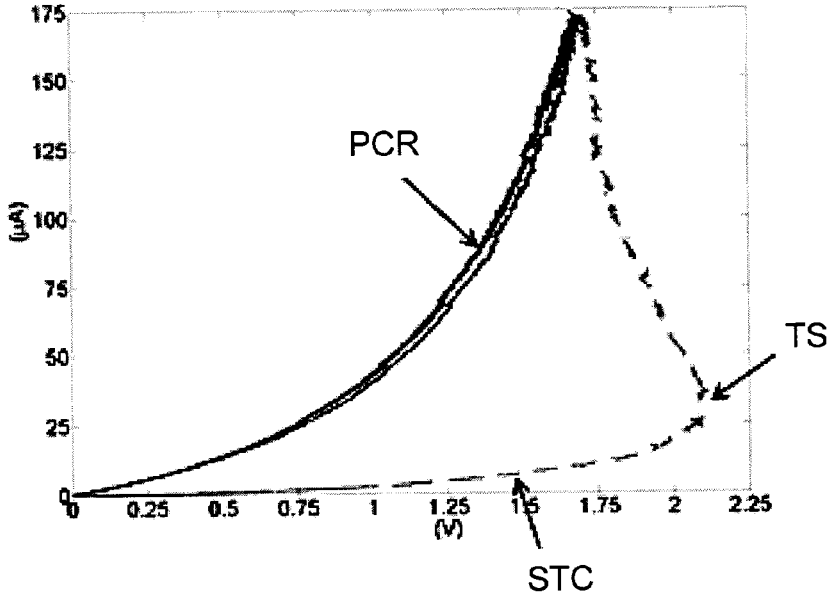
FIG. 6 is a graph representing two consecutive I-V curves at a same location, as measured for a layer of amorphous carbon (before and after local switching), with the set-up of FIG. 3.

FIG. 6 represents two consecutive I-V curves measured at a same location, for a layer of amorphous carbon (before and after local switching), in accordance with the embodiment of FIG. 3. As seen in FIG. 6: before switching (dashed curve) the material 10 first exhibits a sub-threshold conduction regime STC, for voltages below ~2.1 V. The switching threshold is observed at about 2.1 V in this example (which value depends on the thickness of layer 10, as said). Performing the same measure a second time, after the switching as occurred, leads to the superimposed PCR curve (full-line), which reflects a permanent change in resistance.

Figure 7:
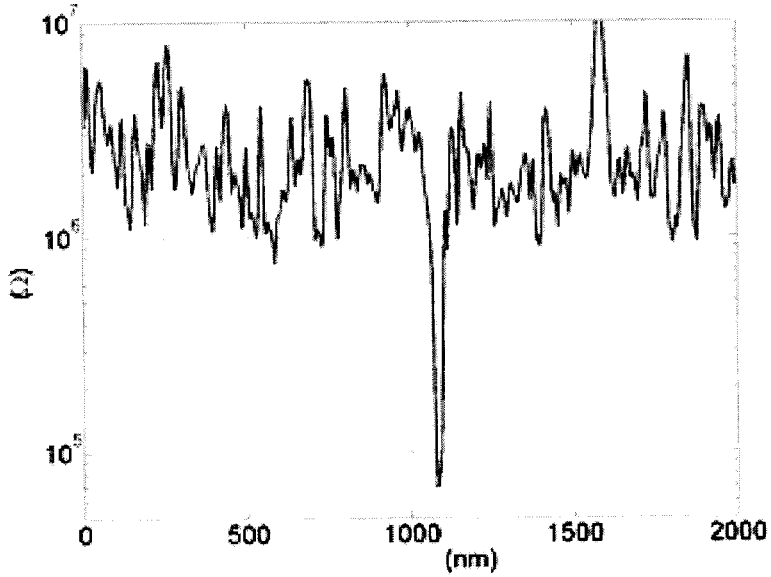
FIG. 7 is a graph representing a resistance signal measured along one direction in a plane corresponding to the resistance map of FIG. 5.

FIG. 7 represents the resistance signal measured along one direction in a plane corresponding to the resistance map of FIG. 5. The resistance signal sharply drops at the level of the switched area, to values of about $7\ 10^5$ ohms, to be compared to $2\ 10^6$ ohms observed on average in the surrounding region.

In the respects, materials for the resistive layer 10 are preferably chosen to exhibit a (highly) non-linear current-voltage characteristic. The non-linear I-V characteristic is determined by the nature of electrical transport in layer 10, e.g., it results in a low resistance at high field and high-resistance at low field. Usually there is an exponential dependence on the applied voltage, i.e., $\sim V^a$, with typically $1/2<a<2$.

Next, as inventors noted, a tunable contact resistance can be reversed in some cases, for some materials, for instance with application of appropriate voltage/current pulses. This makes it possible to turn-off the NEM switch, e.g., in the event of stiction or other failure modes. Accordingly, present methods may further comprise an additional (de-)conditioning step (i.e., effected in reverse order S3-S1 compared to the conditioning step), to at least partly reverse a previous conditioning step.

The second type of embodiments discussed so far mainly revolves around amorphous carbon: amorphous carbon is indeed preferred because it has low adhesion and good tribological properties. Now, beyond amorphous carbon and related materials, the active layer 10 may comprise a phase-change material, such as GeSbTe or GeTe. In that case, advantage is taken of a Joule-heating induced change of phase materials from amorphous to crystalline phase, a phenomenon which is known per se in applied physics.

The layer 10 may still include metal oxides, preferably such as HfOx, WOx, TaOx or TiOx, or other oxides such as SiOx. The mechanism in that case revolves around a field induced drift of oxygen ions resulting in the formation of filamentary chains of oxygen vacancies or metal precipitates. Again, this phenomenon is known per se.

As another example, the active layer 10 may include a combination of a metal layer (e.g., Cu, Au or Ag) and a resistive solid electrolyte such as SiOx. In that case, resistive solid-electrolytes silicon dioxide, amorphous carbon, etc. are relied upon for the ionic diffusion of mobiles ions such as Cu, Au etc. The underlying mechanism used is that of a field induced drift of mobile ions within the solid-electrolyte to form metallic filaments.

Owing to the pre-conditioning process used to locally switch the first region R1, the later shall consistently exhibit (detectable) changes, not only in terms of electrical conductivity, but also in terms of material structural properties. In particular, depending on the conditioning process and material chosen for the resistive layer 10: such structural properties' changes shall typically be one (or in fact more) of the following:

Local clustering of sp2 hybridized carbon atoms (in the case of a carbon resistive layer);

Formation of localized phase change crystalline regions;

Modulation of Schottky barriers due to migration of oxygen ions or vacancies; and/or Formation of conductive filaments, extending on average along z, Etc.

While the present invention has been described with reference to a limited number of embodiments, variants and the accompanying drawings, it will be understood by those skilled in the art that various changes may be made and equivalents may be substituted without departing from the scope of the present invention. In particular, a feature (device-like or method-like) recited in a given embodiment, variant or shown in a drawing may be combined with or replace another feature in another embodiment, variant or drawing, without departing from the scope of the present invention. Various combinations of the features described in respect of any of the above embodiments or variants may accordingly be contemplated, that remain within the scope of the appended claims. For example, features recited in respect of the first type of embodiment (e.g., FIG. 8) can be used in respect of the second type of embodiments, as illustrated in FIG. 11, which combines aspects of FIGS. 8 and 10. In addition, many minor modifications may be made to adapt a particular situation or material to the teachings of the present invention without departing from its scope. Other dimensions, thicknesses can be contemplated too, notably for the active layer 10 and the conductive pathway 16. Therefore, it is intended that the present invention not be limited to the particular embodiments disclosed, but that the present invention will include all embodiments falling within the scope of the appended claims. FIGS. 2, 3, 8, 10, 11 are not at scale, for clarity. Embodiments of the present invention can be applied to various types of NEM switches, notably as discussed introduction. Only those features which play a foremost role in the present invention have been explicitly described. Other features, like the actuator electrode 14 of FIG. 1 or more generally the actuation mechanism of NEM switches, have not been explicitly discussed since they are assumed to be known.

The invention claimed is:

1. A nano-electromechanical (NEM) switch, comprising:

two electrodes, wherein at least one of the electrodes comprises an active layer thereon, wherein at least one of the electrodes is movable along a given direction (z) from a non-contact position (NCP) to a contact position (CP), wherein a first one of the electrodes contacts a second one of the electrodes at level of a contact point (P), and wherein the active layer exhibits a conductive pathway that (i) extends along the given direction (z) to enable electrical conduction from the first one of the electrodes to the second one of the electrodes in the contact position, and ii) is confined to a given region (R1) of the active layer, the given region (R1) having nanoscale dimensions in a sectional plane (x, y) perpendicular to the given direction (z).

2. The NEM switch of claim 1, wherein the active layer is at least on the first one of the electrodes and comprises a protrusion in the given region (R1), the protrusion supporting at least a part of the conductive pathway and protruding toward the second one of the electrodes, along the given direction (z).

3. The NEM switch of claim 1, wherein the active layer is a resistive layer and the given region (R1) is a first region of the active layer, surrounded by and contiguous with a second region (R2) of the active layer, wherein the resistive layer exhibits:

the conductive pathway extending through a thickness of the resistive layer along the given direction (z); and no conductive pathway in the second region (R2).

4. The NEM switch according to claim 3, wherein an average diameter of the conductive pathway in a sectional plane (x, y) perpendicular to the given direction (z), at the level of the contact point, is of a same order of magnitude as, or less than a smallest one of average diameters of the electrodes at the level of the contact point.

5. The NEM switch according to claim 3, wherein the first region (R1) exhibits one or more material structural properties that are characteristic of a conditioning process comprising application of one or more voltage pulses or current pulses.

6. The NEM switch according to claim 3, wherein an electrical resistance of the first region (R1) is at least 10 times smaller than an electrical resistance of the second region (R2).

7. The NEM switch according to claim 1, wherein the active layer comprises multiple contiguous layers.

8. The NEM switch according to claim 3, wherein the resistive layer has a non-linear current-voltage characteristic.

9. The NEM switch according to claim 1, wherein the conductive pathway has an average diameter of less than 50 nanometers in a sectional plane (x, y) that is perpendicular to the given direction (z); and the active layer has a thickness of less than 100 nanometers.

10. The NEM switch according to claim 1, wherein the active layer is a resistive layer that comprises one of the following materials: amorphous carbon, at least partly crystallized diamond-like carbon, tetrahedral amorphous carbon, hydrogenated amorphous carbon, or doped carbon.

11. The NEM switch according to claim 1, wherein the active layer is a resistive layer that comprises: GeSbTe, GeTe, HfOx, WOx, SiOx, TaOx, or TiOx.

12. The NEM switch according to claim 1, wherein the active layer comprises a combination of: (i) a metal layer comprising a metal such as Cu, Au or Ag; and (ii) a resistive solid electrolyte such as SiOx, GeS, GeSe, WO3, TiO2 or ZrO2.

13. A method of operating a NEM switch, the method comprising:

providing the NEM switch having two electrodes, wherein at least one of the electrodes comprises an active layer thereon, wherein at least one of the electrodes is movable along a given direction (z) from a non-contact position (NCP) to a contact position (CP), wherein a first one of the electrodes contacts a second one of the electrodes at level of a contact point (P), and wherein the active layer exhibits a conductive pathway that (i) extends along the given direction (z) to enable electrical conduction from the first one of the electrodes to the second one of the electrodes in the contact position, and ii) is confined to a given region (R1) of the active layer, the given region (R1) having nanoscale dimensions in a sectional plane (x, y) perpendicular to the given direction (z); and at least one step of setting the electrodes in the contact position to let mobile electric charges pass from the first one of the electrodes to the second one of the electrodes.

14. The method according to claim 13, further comprising, prior to the at least one step of setting the electrodes in the contact position:

forming in the active layer or conditioning the active layer for the active layer to exhibit the conductive pathway.

15. The method according to claim 13, wherein the active layer is a resistive layer deposited at least on the first one of the electrodes and wherein the method comprises a prior step of conditioning the resistive layer for the resistive layer to exhibit the nanoscale conductive pathway.

16. The method according to claim 15, wherein the conditioning step comprises applying one or more voltage pulses or current pulses.

17. The method according to claim 16, wherein the applying of the one or more voltage pulses or current pulses is carried via the second one of the electrodes.

18. The method according to claim 14, further comprising an additional conditioning step to at least partly reverse a previous conditioning step.

* * * * *